United States Patent [19]

Takenouchi et al.

[11] Patent Number: 4,950,179

[45] Date of Patent: Aug. 21, 1990

[54] LOCKING SECURITY MECHANISM OF ELECTRICAL CONNECTOR

[75] Inventors: Kenji Takenouchi; Toshihiko Makita; Mitsuru Matsumoto, all of Shizuoka, Japan

[73] Assignee: Yazaki Corporation, Tokyo, Japan

[21] Appl. No.: 350,483

[22] Filed: May 11, 1989

[30] Foreign Application Priority Data

May 13, 1988 [JP] Japan ..... 63-63041[U]

[51] Int. Cl.[5] ..... H01R 13/627

[52] U.S. Cl. ..... 439/352; 439/357

[58] Field of Search ..... 439/345, 347, 350, 351, 439/352, 353, 354, 355, 356, 357, 358

[56] References Cited

U.S. PATENT DOCUMENTS 4,710,135 12/1987 Aoyama et al. ..... 439/354

FOREIGN PATENT DOCUMENTS 2801427 7/1978 Fed. Rep. of Germany ..... 439/358

59-29351 8/1984 Japan .

*Primary Examiner*—Neil Abrams

*Assistant Examiner*—Khiem Nguyen

*Attorney, Agent, or Firm*—Armstrong, Nikaido, Marmelstein, Kubovcik & Murray

[57] ABSTRACT

A locking security mechanism for an electrical connector having a pair of male and female connector members, locking means and a locking security member mounted in a male connector member in a normally undetachable manner and maintained in a pre-engagement position with a pre-engagement releasing means in a female connector member. When the male and female connector members are engaged with each other, actuating fingers in the female connector member act on a inclined lower surface of pre-engagement fingers in the locking security member to escape the pre-engagement. Locking means in the male connector member comes into engagement with the locking security member unlocked from the pre-engagement state wherein a means for preventing the locking security member from securing in incomplete locking includes a block member provided at the free end of the locking arm member, an enclosure wall portion provided in the main body of the locking securing member for receiving the block member of the locking arm member, and checking lugs provided in the block member and the enclosure portion for abutting with each other.

15 Claims, 5 Drawing Sheets

LOCKING SECURITY MECHANISM OF ELECTRICAL CONNECTOR

BACKGROUND OF INVENTION

1. Field of the Invention

Present invention relates to an improvement of locking security mechanism of connector to be used for the connection of electric wires or the like.

2. Description of Prior Art

Usual lock security mechanism of electrical connector, such as shown in FIGS. 6 & 7, is provided with a locking arm 3 extending forwardly of the outer wall 1 in a male housing M by means of front upright base 2. A female housing F has a shell 6 receiving the male housing M and having a locking chamber 7 into which the locking arm 3 is inserted. When both housings are engaged with each other, an engaging claw 4 at an end of the locking arm is engaged with a securing hole 8. In this locking state, an unlocking preventing piece 9 is detachably inserted between the outer wall 1 and the locking arm 3 so that the locking state may be prevented from unintentional release. In the drawings, 5 is receiving rooms for terminal fittings not shown. Such arrangement is found in Japanese Utility Model Preliminary (laid-open) Publication No. 59-29351.

Prior art locking security mechanisms as such have an arrangement that the unlocking preventing piece 9 is attached after the male and female housing M, F are engaged with each other. Therefore, it has often occurred that during the engagement operation the insertion of the unlocking preventing piece 9 is omitted and the omission is difficult to be found later. Further, as clearly shown also in the drawings, the unlocking preventing piece 9 may be mounted before the male and female housings M, F are engaged together. In this case, any undesired state that both housings are placed in an incomplete locking position cannot be found easily. Moreover, the unlocking preventing piece 9 which is small and separation from the housing is apt to occur in cases of inspection or exchange of the connector. Such released pieces are difficult to find in the engine room of motor-cars or similar locations if lost.

SUMMARY OF THE INVENTION

The present invention aims to provide an improved lock security mechanism for connectors to prevent the locking arm in the housing from any unlocking state by preventing unintentional release of an unlocking preventing member and eliminating an incomplete locking state of the connector.

In order to obtain the aim as mentioned, the present invention provides a lock security mechanism for electrical connectors having a pair of male and female connector members, the male member having a plurality of longitudinal compartments receiving terminal fittings and the female member that has a rear portion having a plurality of longitudinal compartments similar to those of the male member and a front portion having a chamber for receiving at least a front portion of the male connector member. The locking security mechanism includes a pair of locking means respectively provided in the male and female members and a locking security means, characterized in that the locking security means has a locking security member mounted in one of the male or female members in a normally undetachable manner and maintained in a pre-engagement position in which it is prevented from coming into a position for securing the locking of the locking means and a pre-engagement releasing means provided in the other of the male and female members for making the locking security member capable of coming into the position for securing the locking of the pair locking means when the male and female members are engaged.

DESCRIPTION OF THE DRAWINGS

The invention, together with additional objects, features and advantages thereof, will be best understood from the following description, the appended claims and the accompanying drawings in which:

DESCRIPTION

Figure 1:
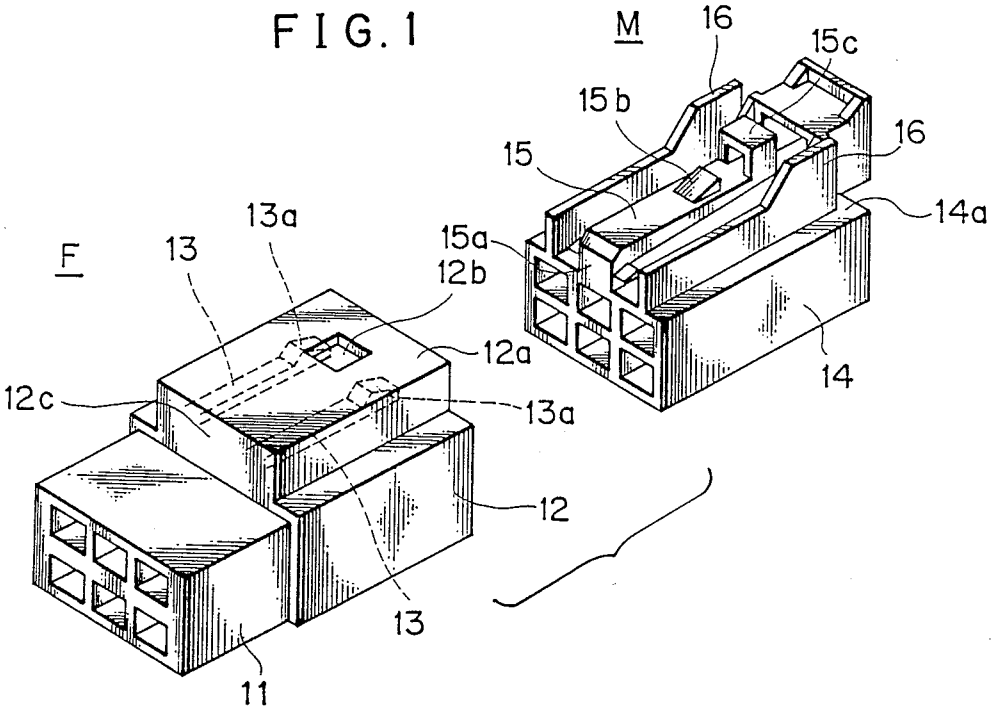
FIG. 1 is a perspective view of an electrical connector equipped with a lock security mechanism in accordance with a preferred embodiment of the invention in which a male and a female housings are shown in their separated state.

Referring to FIG. 1, a female connector member or housing F of synthetic material or the like has a rear portion 11 of rectangular box shape having six longitudinal compartments receiving terminal fittings (not shown) and a front portion 12 of a larger cross section than that of the rear portion 11 which has a rectangular locking opening **12*b* in the upper wall 12*a* higher than that of the rear portion 11. The front portion 12 has a chamber receiving a male connector member or housing M. In the chamber of the front portion 12 are provided two actuating fingers 13, 13 for locking engagement which extend forward from the rear wall 12*c* in a cantilever fashion. The actuating fingers 13, 13 have at the free end an arrowheaded portion 13*a* acting on a locking security member M1**, detachably assembled in the male member M.

The male connector member or housing M also of synthetic material has a rectangular box shape also having six longitudinal compartments connected and aligned with those of the rear portion 11 of the female member F when engaged together. The male member M has an upper wall **14*a* provided on the upper surface with a locking arm member 15 which has an upright base portion 15*a* at the front end of the wall 14*a* and a horizontal arm portion 15*e* connected with the base portion 15*a* and extending rearward and apart from the upper surface of the wall 14*a*. The arm portion 15*e* is provided with a lug 15*b* at the middle portion of its upper surface. The lug 15b has an inclined forward face and is engaged with the locking opening 12b of the female member F when both engaged. The locking arm member 15 has an operating portion 15c at the rear and free end of the horizontal arm portion 15e. On both sides of the locking arm member 15 stand vertical protection walls 16, 16 extending longitudinally apart from and parallel to the arm member 15**.

Behind the locking arm member 15 and between the protection walls 16, 16 is disposed a locking security member M1, having a gate shape base 17 and two flexible securing fingers 17a, 17a extending from the base along the opposite sides of the locking arm member 15. The base 17 has horizontal ridges 17b on the inner face of the side walls for preventing the arm member from unlocking by the engagement with grooves 15d on the opposite side surfaces of the arm portion 15e extending forward from the free end.

The flexible securing fingers 17a, 17a are formed on the lower surface connected with its free end 17a1 with a tapered driven surface 17a2 and an escape concave 17a3. The tapered surface 17a2 is formed with an engaging concave 17a4 inside its middle portion.

The locking arm member 15 is on opposite sides of the upright base 15a provided with engaging projection 18 having a front tapered surface 18a and a rear abutment surface 18b.

Figure 2:
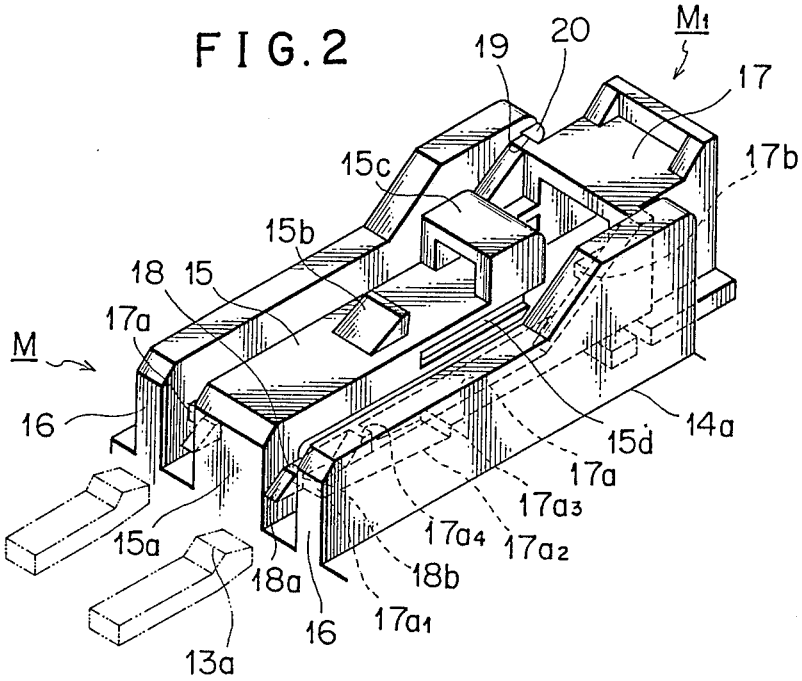
FIG. 2 is an enlarged perspective view of the male housing portion according to FIG. 1.
Figure 3A:
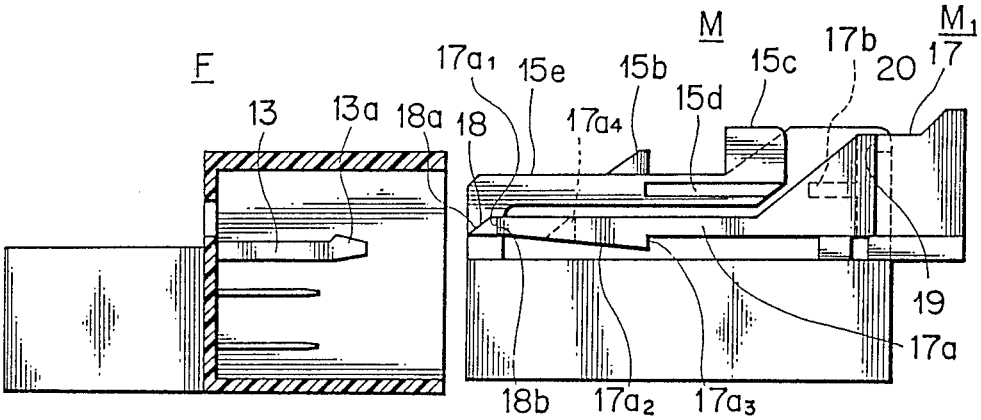
FIGS. 3A, 3B and 3C show the male and female housings in three respective positions of engaging steps, and among them FIG. 3A indicates the pre-engaging position of the lock security member before engagement, FIG. 3B the position at the time when the male and female housings are engaged and FIG. 3C that at the time when the lock security member is moved to the engaging position after engagement of the housings.
Figure 3B:
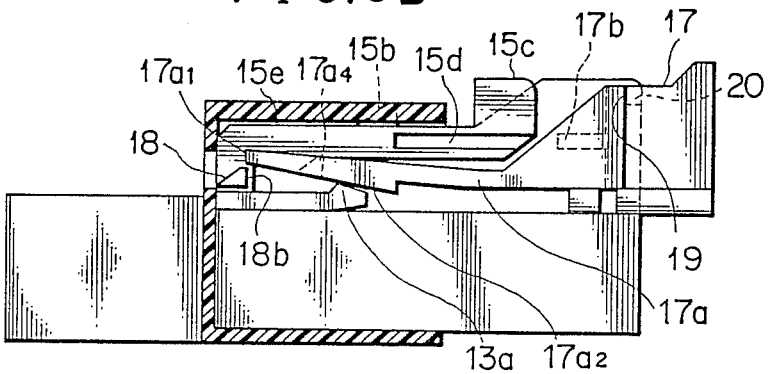

The lock security member M1 is urged to be inserted between the protection walls 16, 16 of the male connector member M from behind to engage a stepped portion 19 with a support protrusion 20 of the protection wall 16 which flexes temporally to allow the portion 19 to pass when the free end 17a1 of the flexible securing fingers 17a, 17a abuts against an abutting surface 18b of the engaging projection 18. This is a pre-engaging position of the lock security member M1 (FIG. 2). In such a state, when the male and female members M, F are engaged, the lug 15b of the locking arm member 15 is insertedly engaged with the locking opening 12b and the engagement unlocking actuating rod 13 provided within the female member F intrudes from the lower portion of the engagement projection 18 to the lower surface of the flexible securing fingers 17a, 17a thereby allowing the actuating projection 13a to raise the free end 17a1 of the flexible securing fingers 17a, 17a by means of the driven tapered surface 17a2 and to remove it from the abutting surface 18b of the engaging projection 18 (see FIG. 3A).

Figure 3C:
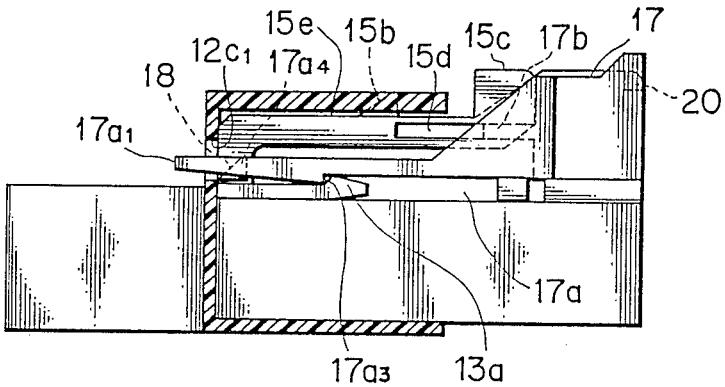

Next, if the locking security member M1 is further pushed, the unlocking preventing portion 17b is engaged with the engagement slit 15d of the locking arm portion 15e to restrain the locking arm, and the flexible securing finger 17a restores through the escape concave 17a3 when the actuating arrowheaded portion 13a of the pre-engagement unlocking actuating rod 13 passes the driven tapered surface 17a2, and the engaging concave 17a4 and the engaging projection 18 are engaged with each other to attain the main engagement in the main position (see FIG. 3C). The free end 17a1 of the fingers 17a projects through an opening 12c1 in the rear wall 12c of the female member front portion 12 and serves as disengaging means in case of unlocking.

Figure 4:
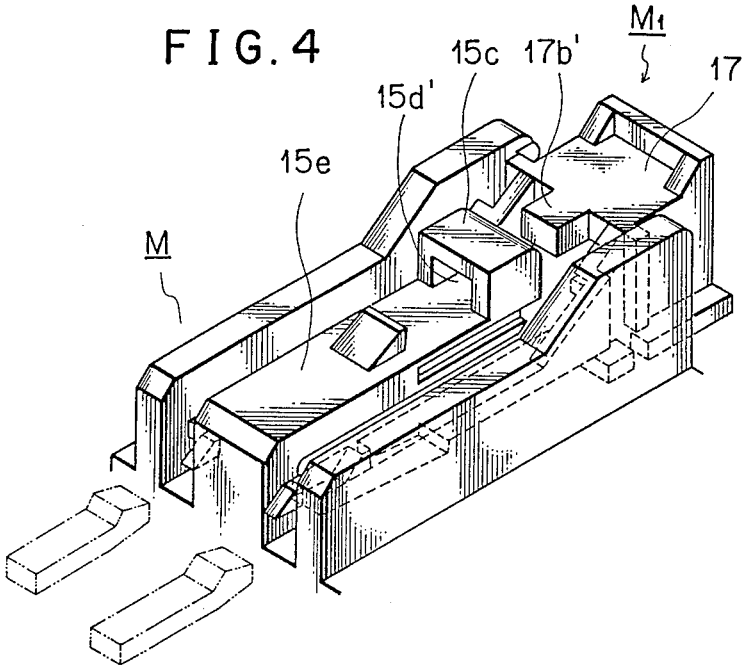
FIG. 4 is a perspective view of another embodiment of the invention in its main portion of the lock security member and the locking arm member.

FIG. 4 shows another embodiment according to this invention in which the operating portion 15c of the locking arm portion 15e is provided with an engagement hole 15d' and the lock security member M1 at the middle portion of its base 17 is provided with an unlocking preventing portion 17b' insertedly engaged with the engaging hole 15d'.

Figure 5:
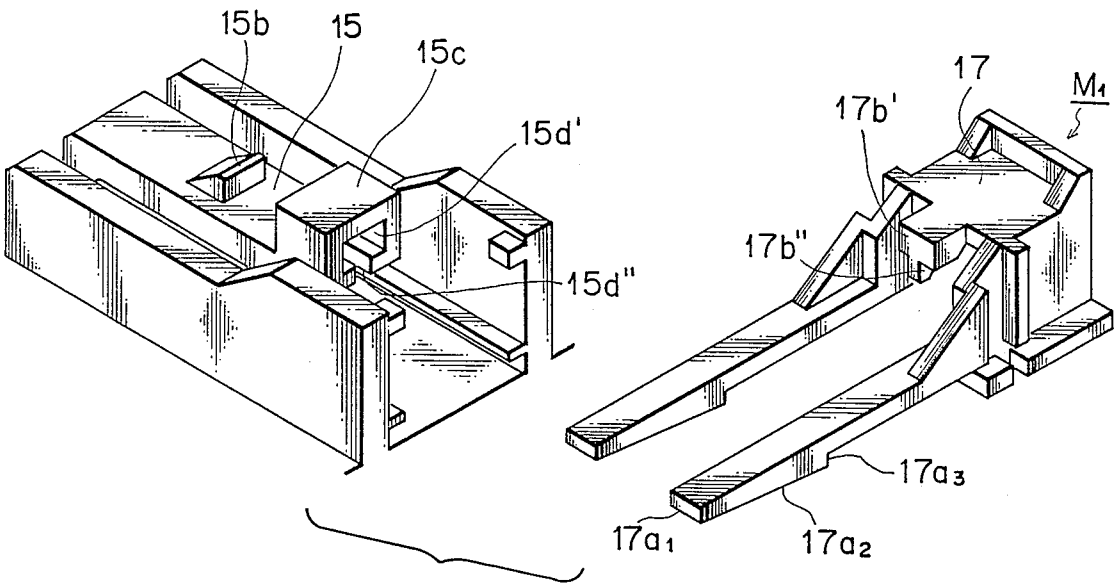
FIG. 5 is a perspective view of still further embodiment of the invention in the main portion of the same members.
Figure 6:
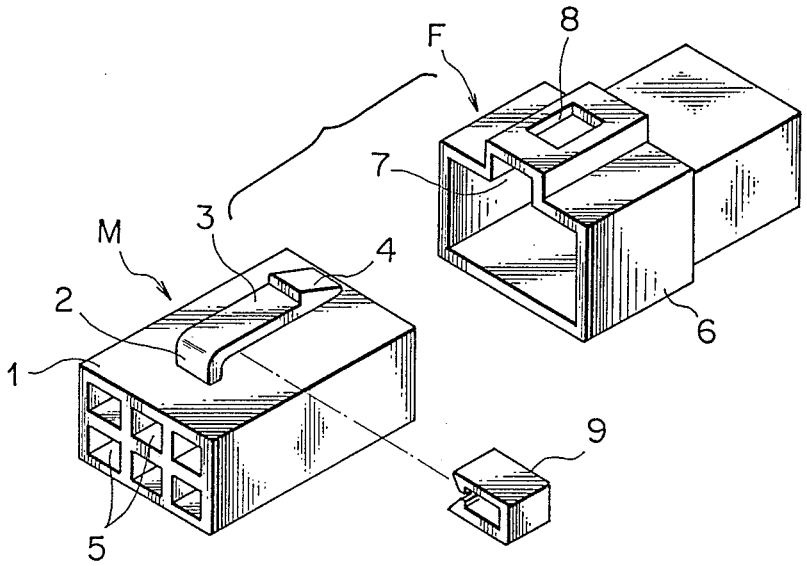
FIG. 6 PRIOR ART
FIG. 6 is a perspective view of a prior art mechanism in a disengaged state of the housings.
Figure 7:
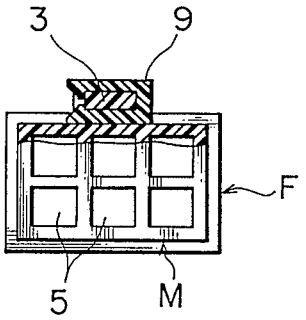
FIG. 7 PRIOR ART
FIG. 7 is a sectional view of the same showing the state of use.

FIG. 5 shows a still further embodiment of this invention wherein the locking arm portion 15e is an operating portion 15c provided with an engaging hole 15d' and an engaging slit 15d'' at the bottom wall. The locking security member M is at the middle portion of its base 17 provided with an unlocking preventing portion 17b' insertedly engaged with the engaging hole 15d' and having a riding lock preventing finger 17b'' to be inserted into the engaging slit 15d''.

As described above, the lock security mechanism according to this invention has a lock security member for preventing the male and female members from unlocking and is normally undetachably mounted on either of the members in a pre-engaging state. Therefore in the engagement operation negligence or omission does not happen with ease and incomplete engagement can be prevented.

What is claimed is:

1. A locking security mechanism for an electrical connector having a pair of male and female connector members, the male connector member having a plurality of longitudinal compartments receiving terminal fittings and the female connector member having a rear portion having a plurality of longitudinal compartments corresponding to those of the male connector member and a front portion having a chamber for receiving at least a front portion of the male connector member, the locking security mechanism comprising:

locking means provided in the male and female connector member; and locking security means, having a locking security member mounted in one of the male or female connector members in a normally undetachable manner and maintained in a pre-engagement position in which it is prevented from coming into a position for securing the locking of the locking means, and a pre-engagement releasing means provided in the other of the male and female connector members for making the locking security member come into position for securing the locking means when the male and female connector members are engaged.

2. A locking security mechanism for an electrical connector as set forth in claim 1 wherein said locking means includes a locking arm member provided in the outer wall of the male connector member and a locking opening provided in the outer wall of the front chamber portion of the female connector member.

3. A locking security mechanism for an electrical connector as set forth in claim 2, wherein said locking security member has a main body positioned behind said locking arm member and having a locking security portion and a longitudinal finger extending from the main body toward a front end of the male connector member and having a pre-engagement retaining portion.

4. A locking security mechanism for an electrical connector as set forth in claim 3, wherein the main body of said locking security member has a holding engagement portion engaged with a portion of the locking arm member to prevent the locking arm member from vertical flexing.

5. A locking security mechanism for an electrical connector as set forth in claim 3 or 4 wherein the main body of said locking security member has a shoulder abutting a lug provided in a portion extending from the male connector member for preventing the locking security member from detaching out of the male connector member.

6. A locking security mechanism for an electrical connector as set forth in claims 3 or 4 wherein said longitudinal finger has a tip end abutting to a pre-engagement retention lug provided at the front portion of the male connector member.

7. A locking security mechanism for an electrical connector as set forth in claim 6 wherein said locking security member having the longitudinal finger has a lower slant surface inclined rearwardly and downwardly and co-acting with the pre-engagement releasing means allowing the tip end of the finger to escape from the pre-engagement retention lug.

8. A locking security mechanism for an electrical connector as set forth in claim 3 or 4 wherein the pre-engagement releasing means is a setting finger extending longitudinally from the rear wall of the male connector receiving chamber in the female connector member, and co-acting with the longitudinal finger of the locking security member.

9. A locking security mechanism for an electrical connector as set forth in claim 8, wherein the pre-engagement releasing finger has a tip end of arrow-headed shape for co-acting with the lower slant surface of the pre-engagement setting finger until the pre-engagement setting finger engages with the releasing finger.

10. A locking security mechanism for an electrical connector having a pair of male and female connector members, the male connector member having a plurality of longitudinal compartments receiving terminal fittings, and the female connector member having a rear portion having a plurality of longitudinal compartments corresponding to those of the male connector member and a front portion having a chamber for receiving at least a front portion of the male connector member, the locking security mechanism comprising:

locking means provided in the male and female connector members for locking the male and female connector members when engaged, said locking means includes a locking arm member provided in the outer wall of the male connector member and a locking opening provided in the outer wall of the front chamber portion of the female connector member; and locking security means for securing the locking of the male and female connector members having a locking security member mounted in the male connector member in a normally undetachable manner and maintained in a pre-engagement position in which it is prevented from coming into a position for securing the locking of the locking means, and a pre-engagement releasing means provided in the female connector member for making the locking security member come into position for securing the locking means when the male and female connector members are engaged, said locking security member having a main body positioned behind said locking arm member and having a locking security portion and longitudinal finger extending from the main body toward a front end of the male connector member and having a pre-engagement retaining portion, and the main body of said locking security member having a holding engagement portion engaged with a portion of the locking arm member when the locking security member comes into the locking security position to prevent the locking arm member from vertical flexing.

11. A locking security mechanism for an electrical connector as set forth in claim 10 wherein the main body of said locking security member has a shoulder abutting a lug provided in a portion extending from the male connector member for preventing the locking security member from detaching out of the male connector member.

12. A locking security mechanism for an electrical connector as set forth in claim 10 wherein said longitudinal finger has a tip end abutting to a pre-engagement retention lug provided at the front portion of the male connector member.

13. A locking security mechanism for an electrical connector as set forth in claim 12 wherein said locking security member having the longitudinal finger has a lower slant surface inclined rearwardly and downwardly and co-acting with the pre-engagement releasing means allowing the tip end of the finger to escape from the pre-engagement retention lug.

14. A locking security mechanism for an electrical connector as set forth in claim 10 wherein the pre-engagement releasing means is a setting finger extending longitudinally from the rear wall of the male connector receiving chamber in the female connector member, and co-acting with the longitudinal finger of the locking security member.

15. A locking security mechanism for an electrical connector as set forth in claim 14 wherein the pre-engagement releasing finger has a tip end of arrow-headed shape for co-acting with the lower slant surface of the pre-engagement setting finger until the pre-engagement setting finger engages with the releasing finger.

* * * * *